US006241483B1

(12) United States Patent
Kato et al.

(10) Patent No.: US 6,241,483 B1
(45) Date of Patent: Jun. 5, 2001

(54) VARIABLE DISPLACEMENT COMPRESSOR

(75) Inventors: Keiichi Kato; Hajime Kurita; Hirotaka Kurakake; Satoshi Inaji, all of Kariya (JP)

(73) Assignee: Kabushiki Kaisha Toyoda Jidoshokki Seisakusho, Kariya (JP)

( * ) Notice: Subject to any disclaimer, the term of this patent is extended or adjusted under 35 U.S.C. 154(b) by 0 days.

(21) Appl. No.: 09/438,107

(22) Filed: Nov. 10, 1999

(30) Foreign Application Priority Data

Nov. 12, 1998 (JP) ..... 10-322108

(51) Int. Cl.[7] ..... F04B 1/26; F04B 1/12
(52) U.S. Cl. ..... 417/222.2; 417/269
(58) Field of Search ..... 417/222.2, 269

(56) References Cited

U.S. PATENT DOCUMENTS 4,011,029 * 3/1977 Shimizu ..... 417/269
5,129,792 * 7/1992 Abousabha ..... 417/312
5,871,337 * 2/1999 Fukanuma et al. ..... 417/222.2

FOREIGN PATENT DOCUMENTS 10-153175 6/1998 (JP) .
10-205446 8/1998 (JP) .

* cited by examiner

*Primary Examiner*—Timothy S. Thorpe
*Assistant Examiner*—Michael K. Gray
(74) *Attorney, Agent, or Firm*—Morgan & Finnegan, LLP

(57) ABSTRACT

A compressor comprises a drive shaft supported in a housing, a piston accommodated in a cylinder bore and connected to the drive plate, a valve plate for separating the cylinder bore from the suction chamber and the discharge chamber. A discharge passage passes through the housing and the valve plate to connect the discharge chamber to the external circuit. Gas is sent from the discharge chamber to the external circuit through the discharge passage. A check valve is located on the valve plate to selectively open and close the discharge passage. The check valve checks gas flow from the external circuit to the discharge chamber. This prevents the pressure in the crank chamber from increasing to an excessive degree.

20 Claims, 3 Drawing Sheets

VARIABLE DISPLACEMENT COMPRESSOR

BACKGROUND OF THE INVENTION

The present invention relates to a variable displacement compressor for vehicle air-conditioning.

In a prior art variable displacement compressor shown in FIG. 4, a drive shaft 103 is rotatably supported in a housing 101, which includes a crank chamber 102. The front end (left end in FIG. 4) of the drive shaft 103 projects from the housing 101 and is coupled to an engine (not shown). A lip seal 104 is located between the housing 101 and the drive shaft 103 to prevent leakage of fluid along the surface of the drive shaft 103.

A lug plate 117 is fixed to the drive shaft 103 in the crank chamber 102. The lug plate 117 is coupled to a swash plate 105 via a hinge mechanism 116. The swash plate 105 is supported by the drive shaft 103 to axially slide and incline with respect to the axis L of the drive shaft 103. The hinge mechanism 116 causes the swash plate 105 to integrally rotate with the drive shaft 103. A limit ring 106 is located on the drive shaft 103. When the swash plate 105 abuts against the limit ring 106, the swash plate 105 is at the minimum inclination position.

The housing 101 includes cylinder bores 107, a suction chamber 108, and a discharge chamber 109. A piston 110 is accommodated in each cylinder bore 107. Each piston 110 is coupled to the swash plate 105. A valve plate 111 separates the cylinder bores 107 from the suction chamber 108 and the discharge chamber 109.

When the drive shaft 103 is rotated by a vehicle engine, the swash plate 105 reciprocates the pistons 110. This draws refrigerant gas from the suction chamber 108 to the corresponding cylinder bore 107 via a suction port 111*a* and a suction valve 111*b*, which are formed in the valve plate 111. Refrigerant gas in the cylinder bore 107 is compressed to reach a predetermined pressure and is discharged to the discharge chamber 109 via a discharge port 111*c* and a discharge valve 111*d*, which are formed in the valve plate 111.

An axial spring 112 is located between the housing 101 and the drive shaft 103. The axial spring urges the drive shaft 103 in the frontward direction (leftward in FIG. 4) and prevents axial chattering of the drive shaft 103.

A bleed passage 113 connects the crank chamber 102 to the suction chamber 108. A pressurizing passage 114 connects the discharge chamber 109 to the crank chamber 102. A displacement control valve 115, which is an electromagnetic valve, adjusts the opening size of the pressurizing passage 114.

The displacement control valve 115 adjusts the flow rate of refrigerant gas from the discharge chamber 109 to the crank chamber 102, which varies the pressure in the crank chamber 102. This varies the inclination of the swash plate 105, the stroke of the pistons 110, and the compressor displacement.

When there is a relatively great cooling demand on a refrigeration circuit that includes the compressor of FIG. 4, for example, when the temperature in a passenger compartment of a vehicle is much higher than a target temperature set in advance, the control valve 115 closes the pressurizing passage 114 and maximizes the compressor displacement.

In this state, when the cooling demand decreases, the control valve 115 quickly and fully opens the closed pressurizing passage 114. Also, when the vehicle is suddenly accelerated while the compressor is operating at the maximum displacement, the control valve 115 quickly and fully opens the pressurizing passage 114 to minimize the displacement to reduce the load applied to the engine.

Accordingly, refrigerant gas in the discharge chamber 109 is quickly supplied to the crank chamber 102, which rapidly increases the pressure in the crank chamber 102 to a high pressure level. Since the amount of refrigerant gas that flows to the suction chamber 108 through the bleed passage 113 is limited, the pressure in the crank chamber 102 quickly increases.

Therefore, the swash plate 105 (as shown by the broken line in FIG. 4) is pressed against the limit ring 106 by a relatively great force when at the minimum inclination position. The swash plate 105 consequently pulls the lug plate 117 in the rearward direction (rightward in FIG. 4) via the hinge mechanism 116. As a result, the drive shaft 103 moves axially against the force of the axial spring 112.

When the drive shaft 103 moves rearward, the pistons 110, which are coupled to the drive shaft 103 via the swash plate 105, also move rearward. Therefore, the top dead center positions of the pistons 110 move toward the valve plate 111, which may cause the pistons 110 to repeatedly collide with the valve plate 111. This generates noise and vibration.

When the drive shaft 103 moves rearward, the axial position of the drive shaft 103 relative to the lip seal 104, which is retained in the housing 101, changes. Normally, a predetermined annular area of the drive shaft 103 contacts the lip seal 104. Foreign particles and sludge adhere to a surface of the drive shaft 103 that is axially adjacent to the predetermined annular area. Therefore, if the axial position of the drive shaft 103 relative to the lip seal 104 changes, sludge enters between the lip seal 104 and the drive shaft 103. This lowers the effectiveness of the lip seal 104 and results in gas leakage from the crank chamber 102.

An objective of the present invention is to provide a variable displacement compressor that prevents the pressure in the crank chamber from increasing to an excessive degree.

To achieve the above objective, the present invention provides a variable displacement compressor compressing gas supplied from an external circuit and returning the gas to the external circuit. The compressor comprises a housing, a cylinder bore formed in the housing, a crank chamber formed in the housing. A suction chamber is formed in the housing such that the suction chamber is connected with the external circuit. Gas is supplied from the external circuit to the suction chamber. A discharge chamber is formed in the housing. A valve plate separates the cylinder bore from the suction chamber and the discharge chamber. A piston is accommodated in the cylinder bore. The piston draws gas from the suction chamber to the cylinder bore via the valve plate. The piston discharges gas, which has been compressed in the cylinder bore, to the discharge chamber via the valve plate. A drive shaft is supported in the housing. A drive plate is coupled to the piston for converting rotation of the drive shaft to reciprocation of the piston. The drive plate is supported on the drive shaft. The drive plate moves between a maximum inclination position and a minimum inclination position in accordance with the pressure in the crank chamber. The inclination of the drive plate determines the piston stroke and the displacement of the compressor. A pressure control mechanism controls the pressure in the crank chamber to change the inclination of the drive plate. A discharge passage passes through the housing and the valve plate to connect the discharge chamber to the external circuit. Gas is sent from the discharge chamber to the external circuit through the discharge passage. A check valve is located on the valve plate to selectively open and close the discharge passage. The check valve is a reed valve. The check valve checks gas flow from the external circuit to the discharge chamber.

Other aspects and advantages of the invention will become apparent from the following description, taken in conjunction with the accompanying drawings, illustrating by way of example the principles of the invention.

BRIEF DESCRIPTION OF THE DRAWINGS

The features of the present invention that are believed to be novel are set forth with particularity in the appended claims. The invention, together with objects and advantages thereof, may best be understood by reference to the following description of the presently preferred embodiments together with the accompanying drawings in which:

FIG. 2(*b*) is a partial enlarged cross-sectional view showing the closed state of the check valve of FIG. 2(*a*);

FIG. 3(*b*) is a partial enlarged cross-sectional view showing the closed state of the check valve of FIG. 3(*a*);

DETAILED DESCRIPTION OF THE PREFERRED EMBODIMENTS

A single-head-type variable displacement compressor for vehicle air-conditioning according to a first embodiment of the present invention will now be described with reference to FIGS. 1–2(*b*).

Figure 1:
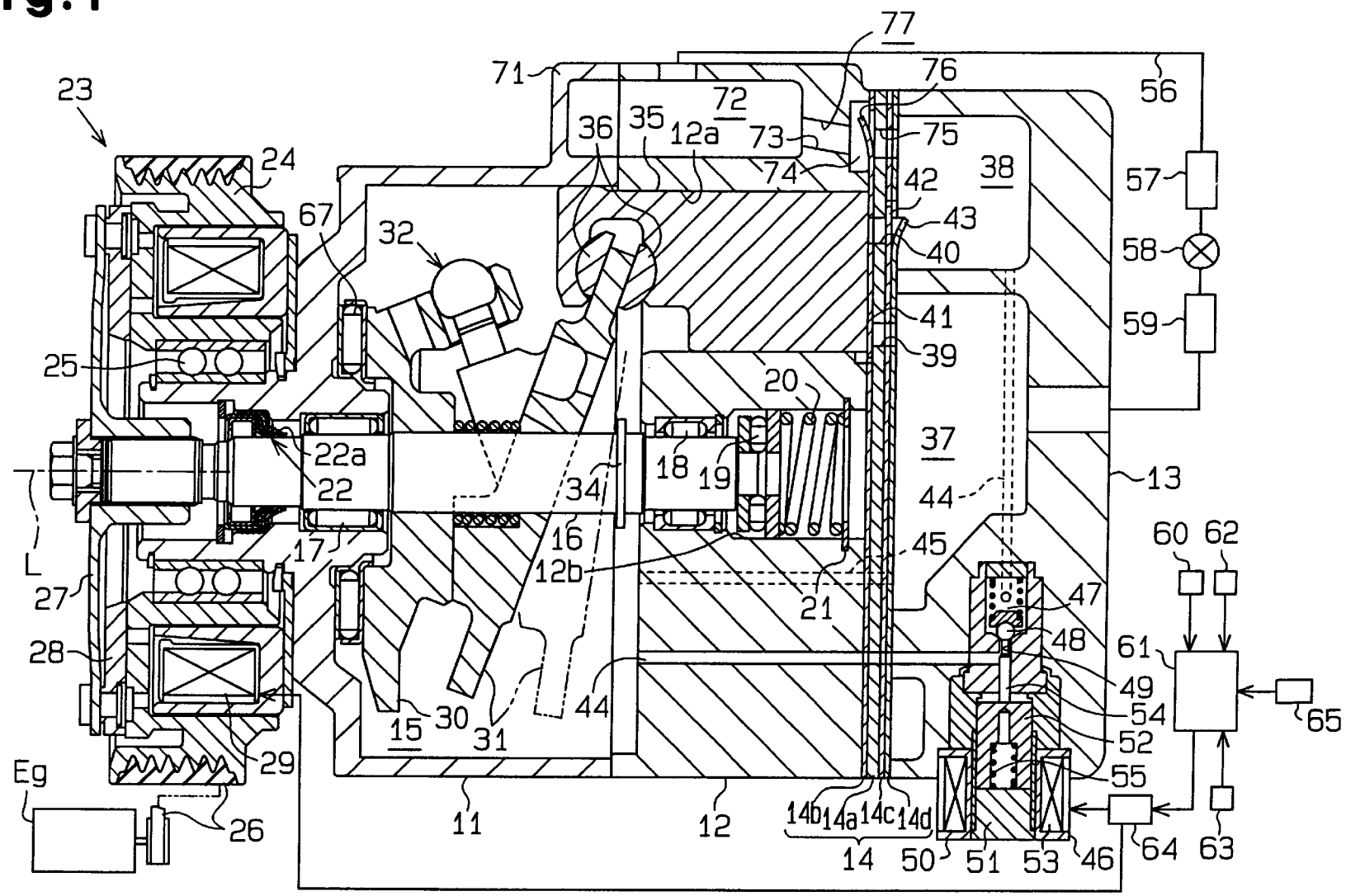
FIG. 1 is a cross sectional view showing a variable displacement compressor according to a first embodiment of the present invention.

As shown in FIG. 1, a front housing member 11 and a rear housing member 13 are coupled to a cylinder block 12. A valve plate 14 is located between the cylinder block 12 and the rear housing member 13. The front housing member 11, the cylinder block 12, and the rear housing member form a compressor housing.

Figure 2A:
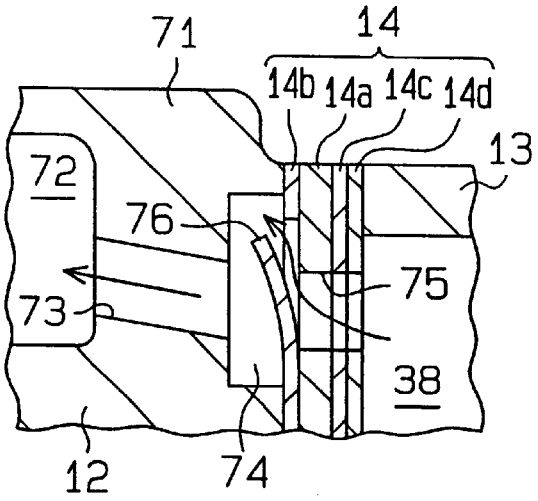
FIG. 2(*a*) is a partial enlarged cross-sectional view showing the open state of the check valve of FIG. 1.
Figure 2B:
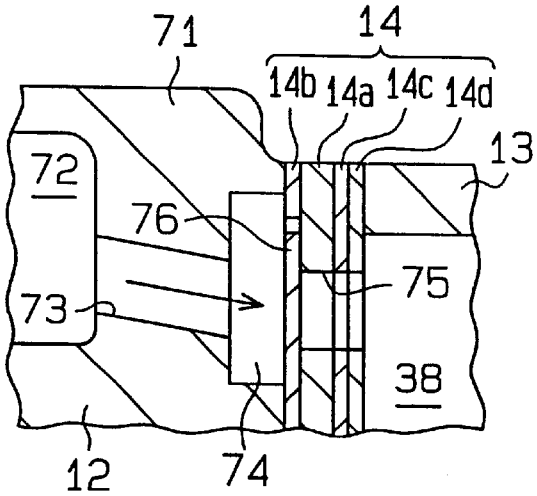

As shown in FIGS. 1, 2(*a*) and 2(*b*), the valve plate 14 includes a main plate 14*a*, a first sub-plate 14*b*, a second sub-plate 14*c*, and a retainer plate 14*d*. The main plate 14*a* is located between the first sub-plate 14*b* and the second sub-plate 14*c*. The retainer plate 14*d* is located between the second sub-plate 14*c* and the rear housing member 13.

A crank chamber 15 is defined between the front housing member 11 and the cylinder block 12. A drive shaft 16 passes via the crank chamber 15 and is supported by the front housing member 11 and the cylinder block 12.

The drive shaft 16 is supported by the front housing member 11 via the radial bearing 17. A central bore 12*b* is formed substantially in the center of the cylinder block 12. The rear end of the drive shaft 16 is located in the central bore 12*b* and is supported by the cylinder block 12 via the radial bearing 18. The thrust bearing 19 and the axial spring 20 are located in the central bore 12*b* between the rear end surface of the drive shaft 16 and the spring seat 21. The axial spring 20, which is a coil spring, urges the drive shaft 16 axially frontward (leftward in FIG. 1) via the thrust bearing 19. The axial spring 20 is an urging member. The thrust bearing 19 prevents transmission of rotation from the drive shaft 16 to the axial spring 20.

The front end of the drive shaft 16 projects from the front housing member 11. A lip seal 22, which is a shaft sealing assembly, is located between the drive shaft 16 and the front housing member 11 to prevent leakage of refrigerant gas along the surface of the drive shaft 16. The lip seal 22 includes a lip ring 22*a*, which is pressed against the surface of the drive shaft 16.

An electromagnetic friction clutch 23 is located between an engine Eg, which serves as an external power source, and the drive shaft 16. The clutch 23 selectively transmits power from the engine Eg to the drive shaft 16. The clutch 23 includes a rotor 24, a hub 27, an armature 28, and an electromagnetic coil 29. The rotor 24 is rotatably supported by the front end of the front housing member 11 via an angular bearing 25. A belt 26 is received by the rotor 24 to transmit power from the engine Eg to the rotor 24. The hub 27, which has elasticity, is fixed to the front end of the drive shaft 16 and supports the armature 28. The armature 28 is arranged to face the rotor 24. The electromagnetic coil 29 is supported by the front wall of the front housing member 11 to face the armature 28.

When the coil 29 is excited while the engine Eg is running, an attraction force based on electromagnetic force is generated between the armature 28 and the rotor 24. Accordingly, the armature 28 contacts the rotor 24, which engages the clutch 23. When the clutch 23 is engaged, power from the engine Eg is transmitted to the drive shaft 16 via the belt 26 and the clutch 23 (See FIG. 1). When the coil 29 is de-excited in this state, the armature 28 is separated from the rotor 24 by the elasticity of the hub 27, which disengages the clutch 23. When the clutch 23 is disengaged, transmission of power from the engine Eg to the drive shaft 16 is disconnected.

As shown in FIG. 1, a lug plate 30 is fixed to the drive shaft 16 in the crank chamber 15. A thrust bearing 67 is located between the lug plate 30 and the inner wall of the front housing member 11. A swash plate 31, which serves as a drive plate, is supported on the drive shaft 16 to slide axially and to incline with respect to the drive shaft 16. A hinge mechanism 32 is located between the lug plate 30 and the swash plate 31. The swash plate 31 is coupled to the lug plate 30 via the hinge mechanism 32. The hinge mechanism 32 integrally rotates the swash plate 31 with the lug plate 30. The hinge mechanism 32 also guides the swash plate 31 to slide along and incline with respect to the drive shaft 16. As the swash plate 31 moves toward the cylinder block 12, the inclination of the swash plate 31 decreases. As the swash plate 31 moves toward the lug plate 30, the inclination of the swash plate 31 increases.

A limit ring 34 is attached to the drive shaft 16 between the swash plate 31 and the cylinder block 12. As shown by the broken line in FIG. 1, the inclination of the swash plate 31 is minimized when the swash plate 31 abuts against the limit ring 34. On the other hand, as shown by solid lines in FIG. 1, the inclination of the swash plate 31 is maximized when the swash plate 31 abuts against the lug plate 30.

Cylinder bores 12*a* are formed in the cylinder block 12. The cylinder bores 12*a* are arranged at equal angular intervals about the axis L of the drive shaft 16. A single head piston 35 is accommodated in each cylinder bore 12*a*. Each piston 35 is coupled to the swash plate 31 via a pair of shoes 36. The swash plate 31 converts rotation of the drive shaft 16 into reciprocation of the pistons 35.

A suction chamber 37, which is a suction pressure zone, is defined in the substantial center of the rear housing member 13. A discharge chamber 38, which is a discharge pressure zone, is formed in the rear housing member 13 and surrounds the suction chamber 37. The main plate 14*a* of the valve plate 14 includes suction ports 39 and discharge ports 40, which correspond to each cylinder bore 12*a*. The first sub-plate 14*b* includes flaps that form the suction valves 41, which correspond to the suction ports 39. The second sub-plate 14*c* includes flaps that form the discharge valves 42, which correspond to the discharge ports 40. The retainer plate 14*d* includes retainers 43, which correspond to the discharge valves 42. Each retainer 43 determines the maximum opening size of the corresponding discharge valve 42.

When each piston 35 moves from the top dead center position to the bottom dead center position, refrigerant gas in the suction chamber 37 flows into the corresponding cylinder bore 12*a* via the corresponding suction port 39 and suction valve 41. When each piston 35 moves from the bottom dead center position to the top dead center position, refrigerant gas in the corresponding cylinder bore 12*a* is compressed to a predetermined pressure and is discharged to the discharge chamber 38 via the corresponding discharge port 40 and discharge valve 42.

A pressurizing passage 44 connects the discharge chamber 38 to the crank chamber 15. A bleed passage 45, which is a pressure release passage, connects the crank chamber 15 to the suction chamber 37. The bleed passage 45 functions as a control passage that connects the crank chamber 15 to a selected chamber, which is the suction chamber 37 in this embodiment. A displacement control valve 46 is located in the pressurizing passage 44. The control valve 46 adjusts the flow rate of refrigerant gas from the discharge chamber 38 to the crank chamber 15 by varying the opening size of the pressurizing passage 44. The bleed passage 44 and the control valve 46 form a pressure control mechanism. The pressure in the crank chamber 15 is varied in accordance with the relation between the flow rate of refrigerant from the discharge chamber 38 to the crank chamber 15 and that from the crank chamber 15 to the suction chamber 37 through the bleed passage 45. Accordingly, the difference between the pressure in the crank chamber 15 and the pressure in the cylinder bores 12*a* is varied, which varies the inclination of the swash plate 31. This varies the stroke of each piston 35 and the displacement.

The control valve 46 will now be described. A valve chamber 47 is formed at an upper portion of the control valve 46. A spherical valve body 48 is accommodated in the valve chamber 47. An opening of a valve hole 49 in the valve chamber 47 faces the valve body 48. The valve chamber 47 and the valve hole 49 form part of the pressurizing passage 44.

A solenoid 50 includes a fixed iron core 51, a movable iron core 52, and a cylindrical coil 53. A rod 54 operably couples the movable core 52 to the valve body 48. An opener spring 55 urges the valve body 48 to open the valve hole 49 via the movable core 52 and the rod 54. The coil 53 is located around the fixed core 51 and the movable core 52.

When the solenoid 50 is excited, or when a predetermined current is supplied to the coil 53, an attraction force based on electromagnetic force is generated between the fixed core 51 and the movable core 52. Accordingly, the movable core 52 moves toward the fixed core 51 against the force of the opener spring 55, which causes the valve body 48 to close the valve hole 49. When the solenoid 50 is de-excited, or when the current supply to the coil 53 is stopped, the attraction force between the cores 51 and 52 disappears. Accordingly, the movable core 52 is separated from the fixed core 51 by the force of the opener spring 55, which causes the valve body 48 to open the valve hole 49.

The suction chamber 37 is connected to the external refrigerant circuit 56. The external refrigerant circuit 56 is connected to the discharge chamber 38 through a discharge passage 77. The external refrigerant circuit 56 includes a condenser 57, an expansion valve 58, and an evaporator 59. The external refrigerant circuit 56 and the variable displacement compressor constitute a refrigeration circuit. A controller 61 is connected to an air-conditioner switch 65. The controller 61, which is a computer, is connected to a temperature sensor 60 for detecting the temperature in a passenger compartment, a temperature adjuster 62 for setting a target temperature in the passenger compartment, and a rotation sensor 63 for detecting engine speed of the engine Eg.

The controller 61 instructs a drive circuit 64 to supply an electric current to the coil 53. The current value is determined by the controller 61 based on external information including the temperature detected by the temperature sensor 60, the target temperature set by the temperature adjuster 62, and the engine speed detected by the rotation sensor 63. The drive circuit 64 supplies electric current to the coil 29 of the clutch 23.

When there is a relatively great cooling demand on the refrigeration circuit, for example, when the temperature in the passenger compartment detected by the temperature sensor 60 is greater than the target temperature set by the temperature adjuster 62, the controller 61 instructs the drive circuit 64 to excite the solenoid 50 of the control valve 46. An electric current based on the instruction is supplied from the drive circuit 64 to the coil 53. Accordingly, the attraction force between the fixed core 51 and the movable core 52 increases. This increases the force that urges the valve body 48 to close the valve hole 49, which reduces the size of the pressurizing passage 44.

When the opening size of the valve hole 49 is reduced, the flow rate of refrigerant gas from the discharge chamber 38 to the crank chamber 15 through the pressurizing passage 44 is reduced. Refrigerant gas in the crank chamber 15 continuously flows to the suction chamber 37 through the bleed passage 45. Accordingly, the pressure in the crank chamber 15 is reduced, which increases the inclination of the swash plate 31. This increases the stroke of the piston 35 and the displacement.

When there is a relatively small cooling demand on the refrigeration circuit, for example, when the temperature in the passenger compartment is close to the target temperature set by the temperature adjuster 62, the controller 61 instructs the drive circuit 64 to de-excite the solenoid 50. The current supply from the drive circuit 64 to the coil 53 is stopped by the instruction. As a result, the valve body 48 opens the valve hole 49, which increases the opening size of the pressurizing passage 44.

This increases the supply of refrigerant gas from the discharge chamber 38 to the crank chamber 15. If the supply of refrigerant gas to the crank chamber 15 is greater than the flow rate of refrigerant gas to the suction chamber 37 through the bleed passage 45, the pressure in the crank chamber 15 gradually increases. This reduces the inclination of the swash plate 31, the stroke of the piston 35, and the displacement.

Preferably, the supply of current to the control valve 46 is controlled by a duty cycle in accordance with the cooling demand on the refrigeration circuit. The ratio of the excitation time of the control valve 46 to the de-excitation time, that is, the ratio of the closed time of the pressurizing passage 44 to the opened time, is changed by changing the duty cycle, which adjusts the flow rate of refrigerant gas in the pressurizing passage 44. The flow rate control adjusts the inclination of the swash plate 31 between the minimum inclination and the maximum inclination. Accordingly, the displacement of the compressor 1 is appropriately adjusted between the minimum displacement and the maximum displacement.

As shown in FIG. 1, the discharge passage 77 is formed in the valve plate 14, the cylinder block 12, and the front housing 11, to connect the discharge chamber 38 to the external refrigerant circuit 56. The discharge passage 77 includes a port 75, a valve chamber 74, a connecting passage 73, and a muffler chamber 72.

A discharge muffler 71, which defines the muffler chamber 72, is located on the front housing 11 and the cylinder block 12. A front muffler housing is formed on the front housing 11, and a rear muffler housing is formed on the cylinder block 12. The discharge muffler 71 is formed by joining the muffler housings as shown in FIG. 1. The muffler chamber 72 reduces the pulsation of the refrigerant gas exiting from the discharge chamber 38.

As shown in FIGS. 2(*a*) and 2(*b*), the connecting passage 73 and the valve chamber 74 are formed in the cylinder block 12. A recess is formed in the rear surface of the cylinder block 12. The recess is closed by the valve plate 14 to form the valve chamber 74. The connecting passage 73 connects the muffler chamber 72 to the valve chamber 74.

The port 75 is formed in the main plate 14*a*, the second plate 14*c* and the retainer plate 14*d* to connect the discharge chamber 38 to the valve chamber 74. A check valve 76, which is a reed valve, is formed on the valve plate 14 in the valve chamber 74. A valve flap of the check valve 76 is integral with the first sub-plate 14*b*.

The check valve 76 moves between the opened position shown in FIG. 2(*a*) and the closed position shown in FIG. 2(*b*) in accordance with the difference between the pressure in the discharge passage 77 upstream of the check valve 76 and the pressure in the discharge passage 77 downstream of the check valve 76, that is, the difference between the pressure in the discharge chamber 38 and the pressure in the muffler chamber 72. When the pressure in the muffler chamber 72 is lower than the pressure in the discharge chamber 38, the check valve 76 is opened as shown in FIG. 2(*a*). When the pressure in the muffler chamber 72 is greater than the pressure in the discharge chamber 38, the check valve 76 is closed as shown in FIG. 2(*b*).

When a passenger raises the target temperature with the temperature adjuster 62 while the compressor is operating at the maximum displacement, the controller 61 judges that the cooling demand on the refrigeration circuit has been lowered and stops the current supply to the solenoid 50 of the control valve 46 to minimize the compressor displacement. When the engine speed detected by the rotation sensor 63 suddenly increases (when the vehicle is being quickly accelerated), the controller 61 stops the current supply to the solenoid 50 of the control valve 46 to minimize the compressor displacement so that the load on the engine Eg is reduced.

When the switch 63 is turned off or the engine Eg of the vehicle is stopped during the operation of the compressor, the controller 61 stops the supply of current from the drive circuit 64 to the coil 53 of the control valve 46 and to the coil 29 of the clutch 23. When the coil 29 of the clutch 23 is de-excited, the armature 28 is separated from the rotor 24, which disconnects power transmission from the engine Eg to the compressor.

In this case, since the control valve 46 quickly and fully opens the pressurizing passage 44, refrigerant gas in the discharge chamber 38 quickly flows to the crank chamber 15. Since the flow rate of gas from the crank chamber 15 through the bleed passage 45 is relatively low, the pressure in the crank chamber 15 suddenly increases. On the other hand, the pressure in the discharge chamber 38 decreases since gas in the discharge chamber 38 quickly flows to the crank chamber 15. When the pressure in the discharge chamber 38 is lower than that in the muffler chamber 72, the check valve 76 closes the port 75.

As a result, gas flow from the condenser 57 of the refrigerant circuit 56 to the discharge chamber 38 is prevented and the pressure in the discharge chamber 38 continues to decrease. The flow rate of gas from the discharge chamber 38 to the crank chamber 15 is relatively slow when the difference between the pressure in the discharge chamber 38 and that in the crank chamber 15 is relatively small. Accordingly, if the pressure in the discharge chamber 38 is relatively low, refrigerant gas flows slowly from the discharge chamber 38 to the crank chamber 15. As a result, an excessive increase of pressure in the crank chamber 15 is prevented, which prevents the swash plate 31 from being pressed against the limit ring 34 by an excessive force when the swash plate 31 is at the minimum inclination position. Accordingly, the drive shaft 16 is prevented from moving axially against the force of the axial spring 20.

Each piston 35 is connected to the drive shaft 16 via the lug plate 30, the hinge mechanism 32, the swash plate 31, and the shoes 36. The drive shaft 16 is prevented from moving rearward, which prevents the top dead center positions of the pistons 35 from moving toward the valve plate 14. This prevents collision of the pistons 35 with the valve plate 14 when the pistons 35 are at their top dead center positions.

Therefore, the drive shaft 16 does not move with respect to the lip seal 22. That is, the position of the drive shaft 16 with respect to the lip ring 22*a* of the lip seal 22 does not change. Therefore, sludge does not get between the lip ring 22*a* and the drive shaft 16. This extends the life of the lip seal 22 and prevents leakage of gas from the crank chamber 15.

The armature 28 of the clutch 23 moves with respect to the rotor 24 in the direction of axis L and contacts or separates from the rotor 24. In the present embodiment, since the rearward movement of the drive shaft 16 is prevented, a desirable clearance is maintained between the rotor 24 and the armature 28 when the clutch 23 is disengaged. Accordingly, power transmission between the rotor 24 and the armature 28 is disrupted without fail when the clutch 23 is disengaged. This prevents noise, vibration, and heat that are caused by unintended contact between the rotor 24 and the armature 28.

The check valve 76, which is a reed valve, is simpler, for example, than a spool valve. The check valve 76 is formed using part of the valve plate 14. Accordingly, the check valve 76 can be arranged in a relatively small space.

The check valve 76 is formed using the first sub-plate 14*b*, which is a part of the valve plate 14. Accordingly, the structure of the check valve 76 is simple compared to a check valve that is formed independently from the valve plate 14.

The check valve 76 is located in the discharge passage 77 between the muffler chamber 72 and the discharge chamber 38. Accordingly, when the pressure in the discharge chamber 38 is lower than the pressure in the muffler chamber 72, refrigerant gas is prevented from reversely flowing from the muffler chamber 72 to the crank chamber 15. This contributes to preventing an excessive increase of pressure in the crank chamber 15.

Second Embodiment

Figure 3A:
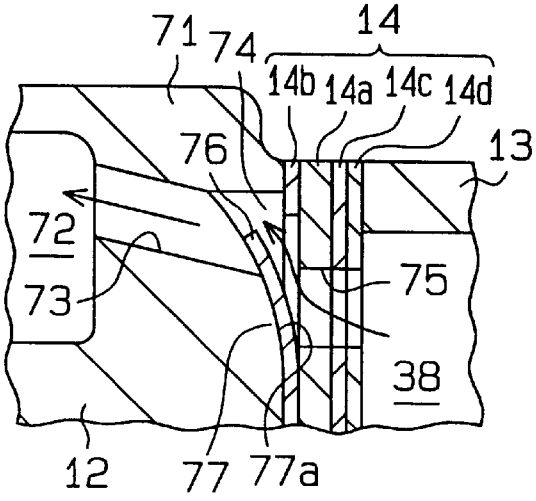
FIG. 3(*a*) is a partial enlarged cross-sectional view showing the open state of a check valve according to a second embodiment.
Figure 3B:
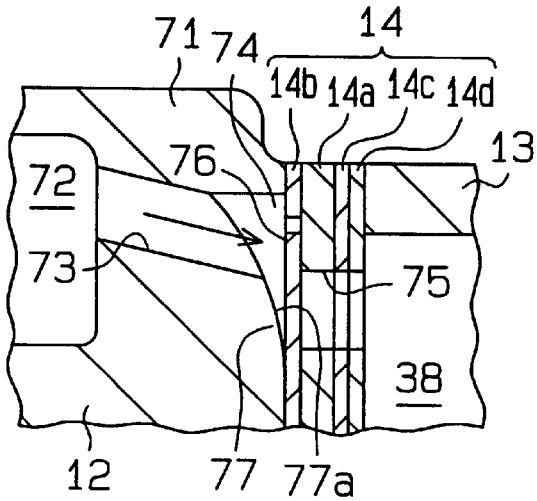
Figure 4:
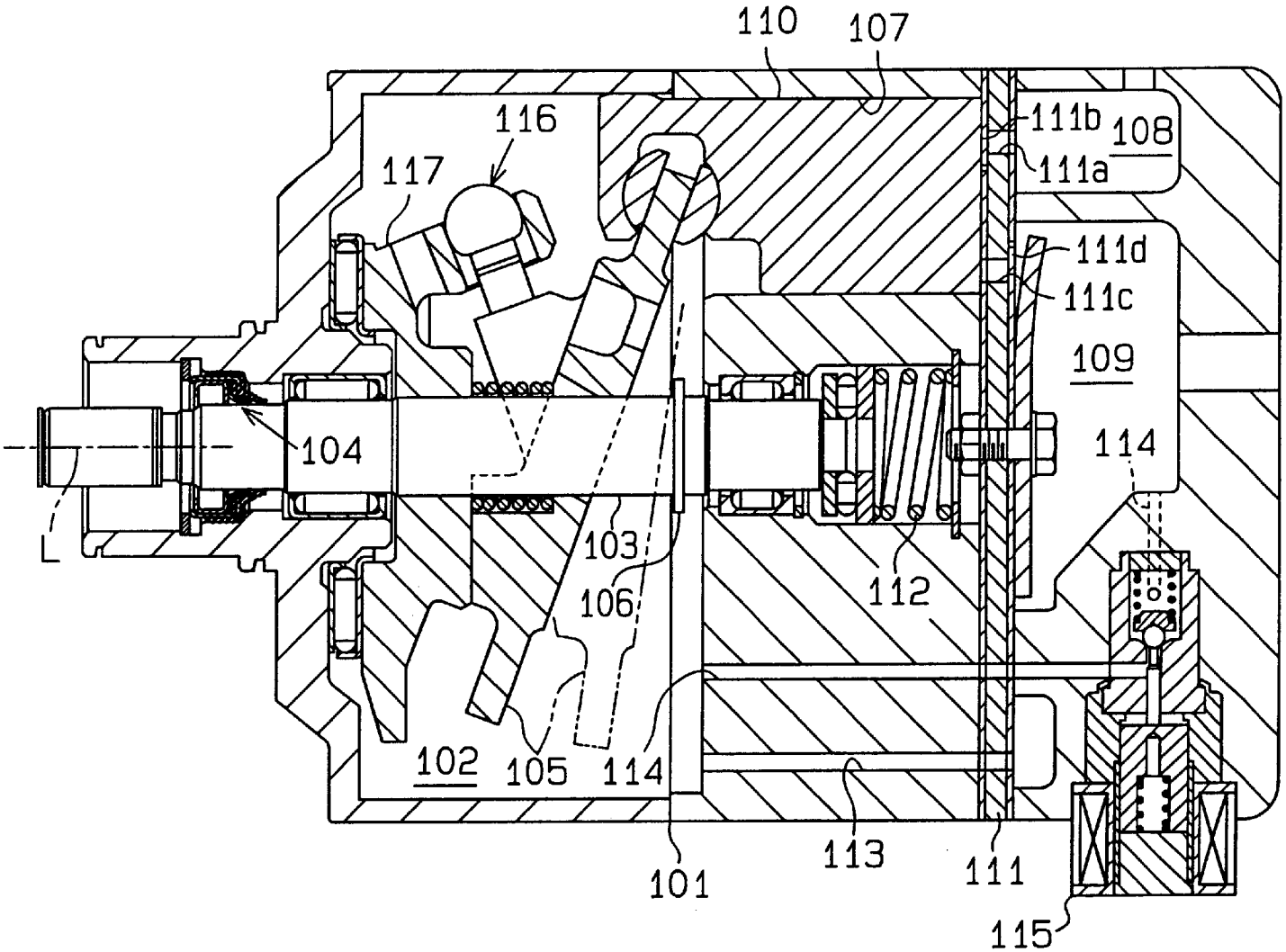
Fig.4 (Prior Art)
FIG. 4 is a cross sectional view of a prior-art variable displacement compressor.

FIGS. 3(*a*) and 3(*b*) show a second embodiment of the present invention. In the second embodiment, a retainer 77, which limits the opening degree of the check valve 76, is provided in addition to the structure of the first embodiment. The retainer 77 is formed on a part of the cylinder block 12 near the valve chamber 74 as shown. The retainer 77 includes a limiting surface 77*a,* which is curved to match the curvature of the check valve 76 when opened.

The opened check valve 76 is supported by the retainer 77. Accordingly, the check valve 76 is prevented from curving more than required, which extends the life of the check valve 76.

Part of the cylinder block 12 forms the retainer 77. This reduces the number of parts and manufacturing steps of the compressor compared to a compressor having an independent the retainer 77.

The opened check valve 76 makes full surface contact with the curved limiting surface 77*a*. Accordingly, the check valve 76 is supported in a stable manner, which extends the life of the check valve 76.

The present invention can further be embodied as follows.

The check valve 76 may be integrally formed with the second sub-plate 14*c* of the valve plate 14. In this case, a port is formed in the retainer plate 14*d,* and a valve chamber for accommodating the check valve 76 is formed in the main plate 14*a* and the second sub-plate 14*b*.

The check valve 76 may be located between the muffler chamber 72 and the external refrigerant circuit 56.

It should be apparent to those skilled in the art that the present invention may be embodied in many other specific forms without departing from the spirit or scope of the invention. Therefore, the present examples and embodiments are to be considered as illustrative and not restrictive and the invention is not to be limited to the details given herein, but may be modified within the scope and equivalence of the appended claims.

What is claimed is:

1. A variable displacement compressor for compressing gas supplied from an external circuit and returning the gas to the external circuit, the compressor comprising:

a housing;

a cylinder bore formed in the housing;

a crank chamber formed in the housing;

a suction chamber formed in the housing such that the suction chamber is connected with the external circuit, wherein gas is supplied from the external circuit to the suction chamber;

a discharge chamber formed in the housing;

a valve plate for separating the cylinder bore from the suction chamber and the discharge chamber;

a piston accommodated in the cylinder bore, wherein the piston draws gas from the suction chamber to the cylinder bore via the valve plate, wherein the piston discharges gas, which has been compressed in the cylinder bore, to the discharge chamber via the valve plate;

a drive shaft supported in the housing;

a drive plate coupled to the piston for converting rotation of the drive shaft to reciprocation of the piston, the drive plate being supported on the drive shaft, wherein the drive plate moves between a maximum inclination position and a minimum inclination position in accordance with the pressure in the crank chamber, wherein the inclination of the drive plate determines the piston stroke and the displacement of the compressor;

a pressure control mechanism for controlling the pressure in the crank chamber to change the inclination of the drive plate;

a discharge passage passing through the housing and the valve plate to connect the discharge chamber to the external circuit, wherein gas is sent from the discharge chamber to the external circuit through the discharge passage; and a check valve located on the valve plate to selectively open and close the discharge passage, wherein the check valve is a reed valve, wherein the check valve checks gas flow from the external circuit to the discharge chamber.

2. The compressor according to claim 1, wherein the check valve closes the discharge passage when the pressure upstream of the check valve is lower than the pressure downstream of the check valve.

3. The compressor according to claim 1, wherein the discharge passage includes a port in the valve plate, wherein the check valve is formed integrally with the valve plate to selectively open and close the port.

4. The compressor according to claim 3, wherein the valve plate includes a main plate and a pair of sub plates, wherein the main plate has a suction port for connecting the suction chamber to the cylinder bore and a discharge port for connecting the discharge chamber to the cylinder bore, wherein one of the sub plates includes a suction valve flap that selectively opens and closes the suction port, the other of the sub plates includes a discharge valve flap that selectively opens and closes the discharge port, and wherein the check valve is formed integrally with one of the sub plates.

5. The compressor according to claim 1, wherein the pressure control mechanism increases the pressure in the crank chamber to move the drive plate to the minimum inclination position, wherein the pressure control mechanism increases the supply of gas from the discharge chamber to the crank chamber to increase the pressure in the crank chamber, wherein the check valve prevents gas flow from the external circuit to the discharge chamber to limit gas flow from the discharge chamber to the crank chamber.

6. The compressor according to claim 5, wherein the pressure control mechanism includes:

a pressurizing passage for connecting the discharge passage to the crank chamber; and a control valve located in the pressurizing passage, wherein the control valve controls a flow of gas from the discharge chamber to the crank chamber through the pressurizing passage, wherein the control valve substantially fully opens the pressurizing passage to move the drive plate to the minimum inclination position based on commands from the external of the compressor.

7. The compressor according to claim 5, wherein the compressor includes an urging member that urges the drive shaft in an axial direction, which resists axial movement of the drive shaft, wherein the pressure in the crank chamber causes the drive plate to apply an axial force to the drive shaft when the drive plate is located at the minimum inclination position, wherein the check valve limits the pressure in the crank chamber such that the axial force cannot move the drive shaft against the force of the urging member.

8. The compressor according to claim 1, wherein the discharge passage includes a muffler chamber (72), wherein the check valve is located between the muffler chamber (72) and the discharge chamber.

9. The compressor according to claim 1, wherein the compressor has a retainer for limiting the maximum opening degree of the check valve.

10. The compressor according to claim 9, wherein the retainer is formed integrally with the housing.

11. The compressor according to claim 9, wherein the retainer has a curved surface that contacts the check valve.

12. A variable displacement compressor for compressing gas supplied from an external circuit and returning the gas to the external circuit, the compressor comprising:

a housing;

a cylinder bore formed in the housing;

a crank chamber formed in the housing;

a suction chamber formed in the housing such that the suction chamber is connected with the external circuit, wherein gas is supplied from the external circuit to the suction chamber;

a discharge chamber formed in the housing;

a valve plate for separating the cylinder bore from the suction chamber and the discharge chamber;

a piston accommodated in the cylinder bore, wherein the piston draws gas from the suction chamber to the cylinder bore via the valve plate, wherein the piston discharges gas, which has been compressed in the cylinder bore, to the discharge chamber via the valve plate;

a drive shaft supported in the housing;

a drive plate coupled to the piston for converting rotation of the drive shaft to reciprocation of the piston, the drive plate being supported on the drive shaft, wherein the drive plate moves between a maximum inclination position and a minimum inclination position in accordance with the pressure in the crank chamber, wherein the inclination of the drive plate determines the piston stroke and the displacement of the compressor;

a pressurizing passage for connecting the discharge passage to the crank chamber;

a control valve located in the pressurizing passage, wherein the control valve controls a flow of gas from the discharge chamber to the crank chamber through the pressurizing passage;

a discharge passage passing through the housing and the valve plate to connect the discharge chamber to the external circuit, wherein the discharge passage includes a port in the valve plate, wherein gas is sent from the discharge chamber to the external circuit through the discharge passage; and a check valve formed integrally with the valve plate to selectively open and close the port, wherein the check valve is a reed valve, wherein the check valve closes the port when the pressure upstream of the check valve is lower than the pressure downstream of the check valve.

13. The compressor according to claim 12, wherein the valve plate includes a main plate and a pair of sub plates, wherein the main plate has a suction port for connecting the suction chamber to the cylinder bore and a discharge port for connecting the discharge chamber to the cylinder bore, wherein one of the sub plates includes a suction valve flap that selectively opens and closes the suction port, the other of the sub plates includes a discharge valve flap that selectively opens and closes the discharge port, and wherein the check valve is formed integrally with one of the sub plates.

14. The compressor according to claim 12, wherein the control valve increases the pressure in the crank chamber to move the drive plate to the minimum inclination position, wherein the control valve increases the supply of gas from the discharge chamber to the crank chamber to increase the pressure in the crank chamber, wherein the check valve prevents gas flow from the external circuit to the discharge chamber to limit gas flow from the discharge chamber to the crank chamber.

15. The compressor according to claim 14, wherein the compressor includes an urging member that urges the drive shaft in an axial direction, which resists axial movement of the drive shaft, wherein the pressure in the crank chamber causes the drive plate to apply an axial force to the drive shaft when the drive plate is located at the minimum inclination position, wherein the check valve limits the pressure in the crank chamber such that the axial force cannot move the drive shaft against the force of the urging member.

16. The compressor according to claim 12, wherein the discharge passage includes a muffler chamber (72), wherein the check valve is located between the muffler chamber (72) and the discharge chamber.

17. The compressor according to claim 12, wherein the compressor has a retainer for limiting the maximum opening degree of the check valve.

18. The compressor according to claim 17, wherein the retainer is formed integrally with the housing.

19. The compressor according to claim 17, wherein the retainer has a curved surface that contacts the check valve.

20. A compressor for compressing gas supplied from an external circuit to a suction chamber and returning the gas from a discharge chamber to the external circuit, having a drive plate supported on a drive shaft, a piston connected to the drive plate and accommodated in a cylinder bore, and a valve plate for separating the cylinder bore from the suction chamber and the discharge chamber, wherein the piston draws gas from the suction chamber to the cylinder bore via the valve plate, wherein the piston discharges gas, which has been compressed in the cylinder bore, to the discharge chamber via the valve plate, the compressor comprising:

a discharge passage passing through the valve plate to connect the discharge chamber to the external circuit, wherein gas is sent from the discharge chamber to the external circuit through the discharge passage; and a check valve located on the valve plate to selectively open and close the discharge passage, wherein the check valve is a reed valve, and wherein the check valve checks gas flow from the external circuit to the discharge chamber.

* * * * *

UNITED STATES PATENT AND TRADEMARK OFFICE

CERTIFICATE OF CORRECTION

PATENT NO. : 6,241,483 B1
DATED : June 5, 2001
INVENTOR(S) : Keiichi Karo et al.

It is certified that error appears in the above-identified patent and that said Letters Patent is hereby corrected as shown below:

Title page,
Item [56] References Ctied, please add:

-- U.S. PATENT DOCUMENTS

| | | | |
|---|---|---|---|
| 5,112,198 | 5/1992 | Skinner | 417/269 -- |

-- FOREIGN PATENT DOCUMENTS

| | | |
|---|---|---|
| 197 09 935 A | 11/1997 | (DE) |
| 196 44 431 A | 4/1997 | (DE) |
| 198 10 789 | 9/1998 | (DE) -- |

Signed and Sealed this

Twenty-eighth Day of May, 2002

*Attest:*

*Attesting Officer*

JAMES E. ROGAN
*Director of the United States Patent and Trademark Office*